US007100775B2

(12) United States Patent
Yeh

(10) Patent No.: US 7,100,775 B2
(45) Date of Patent: Sep. 5, 2006

(54) BINDER FOR A SUSPENSION FILE

(76) Inventor: Wei Kang Yeh, 9F-3, No. 28, Peiping 4 St., Taichung (TW)

( * ) Notice: Subject to any disclaimer, the term of this patent is extended or adjusted under 35 U.S.C. 154(b) by 494 days.

(21) Appl. No.: 10/739,106

(22) Filed: Dec. 19, 2003

(65) Prior Publication Data

US 2005/0135873 A1 Jun. 23, 2005

(51) Int. Cl.
*A47B 63/02* (2006.01)
*B42F 15/00* (2006.01)

(52) U.S. Cl. ..... 211/46; 312/184; 402/3

(58) Field of Classification Search ..... 211/46, 211/126.13; 248/292.12; 40/354; 269/202; 312/183, 184; 402/3
See application file for complete search history.

(56) References Cited

U.S. PATENT DOCUMENTS 1,478,920 A * 12/1923 Schepman ..... 402/27
3,255,758 A * 6/1966 Gauche ..... 211/162
3,308,831 A * 3/1967 Kritske ..... 24/67.1
3,865,445 A * 2/1975 Dean et al. ..... 312/184
3,885,846 A * 5/1975 Chuang et al. ..... 312/306
3,957,321 A * 5/1976 Rose ..... 312/184
4,208,146 A * 6/1980 Schudy ..... 402/4
5,328,259 A 7/1994 Meriaux
5,393,154 A * 2/1995 Hubbell ..... 402/4
5,911,763 A * 6/1999 Quesada ..... 70/120
5,946,953 A * 9/1999 Feldpausch ..... 70/78
6,015,195 A * 1/2000 Anderson et al. ..... 312/223.2
6,626,602 B1 * 9/2003 Yuen ..... 402/73
7,059,483 B1 * 6/2006 Scudder ..... 211/46

FOREIGN PATENT DOCUMENTS

DE 197 01 864 C 1 10/1997
DE 298 20 219 U 1 4/1999

* cited by examiner

*Primary Examiner*—Jennifer E. Novosad
*Assistant Examiner*—Jared W. Newton
(74) *Attorney, Agent, or Firm*—Bacon & Thomas

(57) ABSTRACT

A binder for a suspension file has a body, a cover mounted on the body and a control element mounted inside the body. The control element has two rods and a pinion gear. Each rod has a rack gear formed on the inner end and a hook formed on the outer end, and the pinion gear is mounted between the rods and engages the rack gears. One of the rods has a controller securely attached to the rod and extending out of the body. When the controller is pushed or pulled, the hooks will extend or retract simultaneously.

3 Claims, 9 Drawing Sheets

BINDER FOR A SUSPENSION FILE

BACKGROUND OF THE INVENTION

1. Field of Invention

The present invention relates to a binder, and more particularly to a binder used for a suspension file.

2. Description of the Related Art

With reference to FIG. 8, a conventional suspension file (60) has a conventional binder (62) and a detachable folder (70). The binder (62) has a top edge (not numbered), a bottom edge (not numbered), two ends (not numbered), a C-shaped clamp (61), multiple holes (63), two slots (65), two hooks (66) and an optional label tab (64). The C-shaped clamp (61) is integrally formed on the bottom edge of the binder (62). The holes (63) are defined through the binder (62), and each slot (65) is defined through the binder (62) respectively near the ends. Each hook (66) is slidably mounted in one of the slots (65). The optional label tab (64) is mounted selectively in adjacent holes (63) in the binder (62). The C-shaped clamp (61) is attached to an edge of the folder (70).

Disadvantages of the conventional binder (62) for a suspension file (60) are described as the followings:

1. When the conventional suspension file is used, the hooks (66) on the binder (62) need to be pulled out. Pulling two hooks (66) out is not convenient for a user.

2. The label tab (64) is attached to the binder (62). When the label tab (64) is not used and removed from the binder (62), can be easily lost when stored inside the suspension file (60).

With reference to FIG. 9, a second type of conventional binder (90) for a suspension file has two transverse bodies (not numbered) and four hooks (91). Each transverse body has two ends (not numbered), and two of the hooks (91) are mounted respectively in the ends of the transverse body. The folder (80) has two top edges (not numbered) and an inner surface (not numbered). Each top edge is folded toward the inner surface and securely attached to the inner surface to form a transverse hole (not numbered). The transverse body is inserted through the transverse hole of the folder (80).

Disadvantages of the second type binder (90) for a suspension file are described as follows.

1. The hooks (91) on the suspension file are fixed and extend outside the suspension file, so the suspension file is not easy to package.

2. When the second type suspension file is packaged, it takes more space, and the packaging cost more.

The suspension file in accordance with the present invention obviates or mitigates the aforementioned problems.

SUMMARY OF THE INVENTION

The primary objective of the present invention is to provide a binder for a suspension file, which has a body, a cover mounted on the body and a control element mounted inside the body. The control element has two rods and a pinion gear. Each rod has a rack gear formed on the inner end and a hook formed on the outer end, and the pinion gear is mounted between and engages the rack gears on the rods. One of the rods has a controller securely attached to the rod, and the controller extends out of the body. When the controller is pushed or pulled, the hooks will extend or retract simultaneously.

Other objectives, advantages and novel features of the invention will become more apparent from the following detailed description when taken in conjunction with the accompanying drawings.

DETAILED DESCRIPTION OF THE INVENTION

Figure 1:
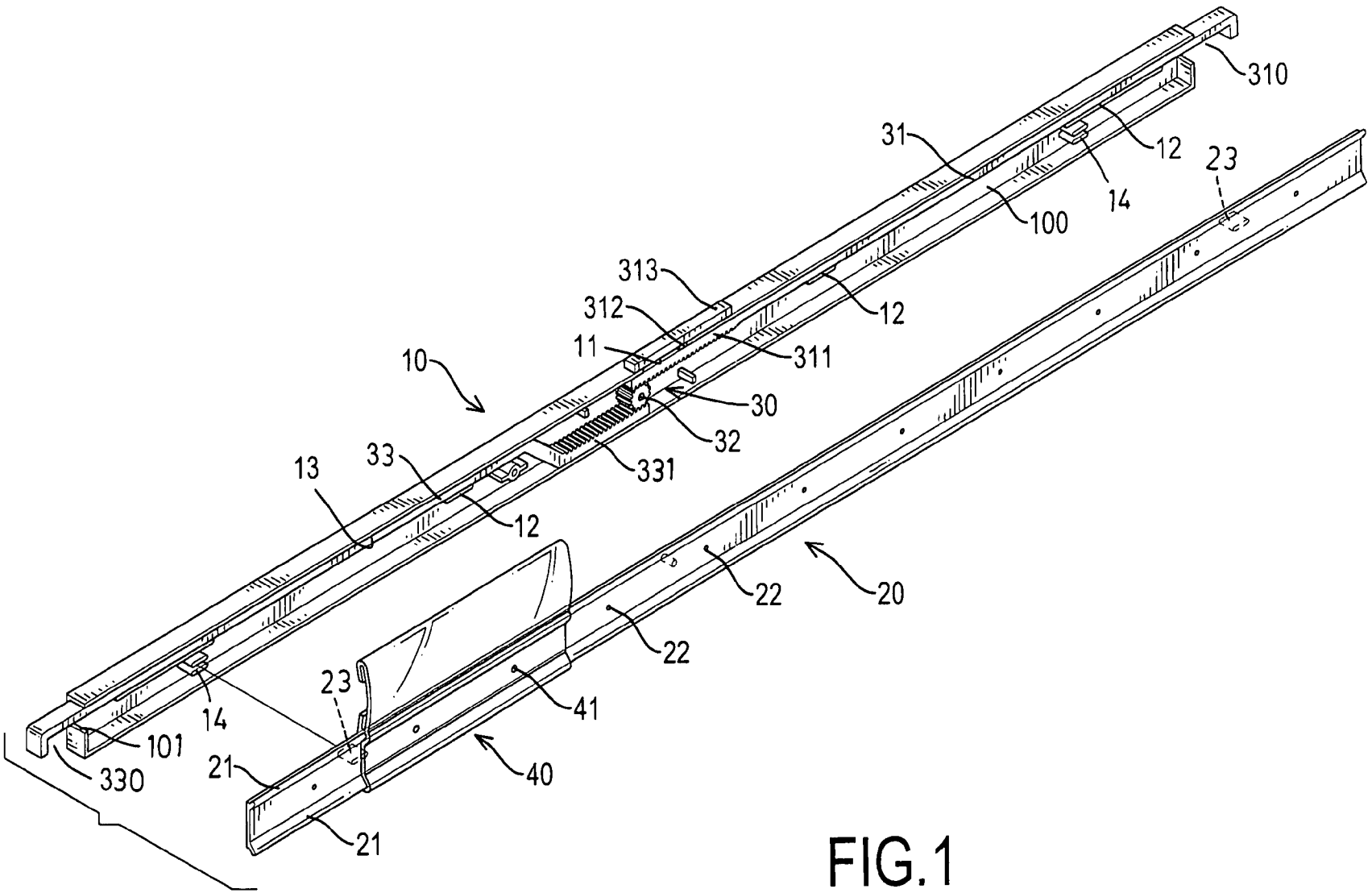
FIG. 1 is an exploded perspective view of a binder for a suspension file in accordance with the present invention.
Figure 2:
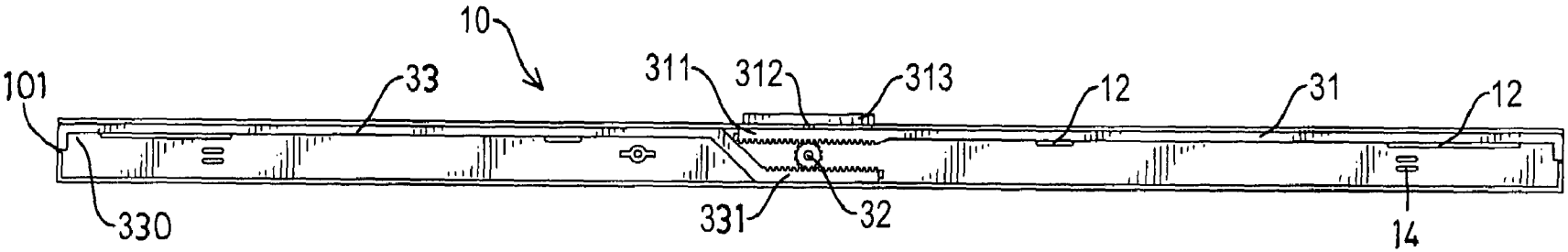
FIG. 2 is a front plan view of the binder for the suspension file in FIG. 1 with the cover removed.
Figure 3:
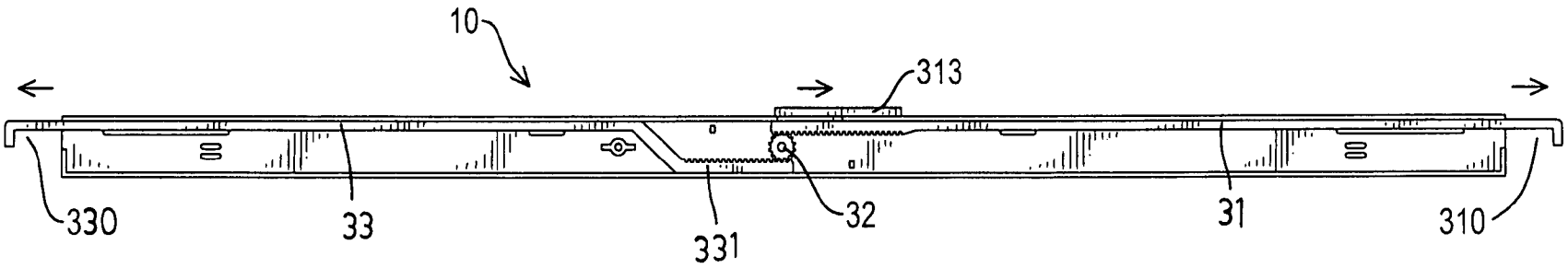
FIG. 3 is a front plan view of the binder for the suspension file in FIG. 1 with the two hooks extended.

With reference to FIGS. 1 to 3, a binder for a suspension file has a body (10), a cover (20), a control element (30) and optional label tab (40).

The body (10) has a top surface (not numbered), a cavity (100), two end surfaces (not numbered), two hook slots (101), an inner surface (not numbered), a control slot (11), multiple guides (12) and multiple female cover connectors (14). The hook slots (101) are defined respectively on the end surfaces near the top surface of the body (10). The control slot (11) is defined in the top surface of the body (10). The guides (12) are formed on the inner surface of the cavity and align with each other to define a sliding path (13). The female cover connectors (14) are formed on the inner surface of the inner cavity.

The cover (20) is mounted on the body (10) to close the cavity in the body (10) and has an inner surface (not numbered), an outer surface (not numbered), a top edge (not numbered), a bottom edge (not numbered), two optional lips (21), multiple optional nubs (22) and multiple connector posts (23). The optional lips (21) are formed respectively on the top edge and the bottom edge and extend toward the outer surface. The multiple optional nubs (22) are respectively formed on the outer surface of the cover (20) and are aligned longitudinally with each other. The multiple connector posts (23) are formed on the inner surface of the cover (20) and face and correspond respectively to the female cover connectors (14).

The control element (30) is mounted in the cavity (100) in the body (10) and has a straight rod (31), a Z-shaped rod (33) and a pinion gear (32). The straight rod (31) and the Z-shaped rod (33) are slidably mounted inside the sliding path (13) in the body (10).

The straight rod (31) has a top surface (not numbered), a neck (312), a controller (313), an inner end (not numbered), an outer end (not numbered), a hook (310) and an upper rack gear (311). The hook (310) is formed on the outer end of the straight rod (31), and the upper rack gear (311) is formed on the inner end of the straight rod (31). The neck (312) is securely formed on the top surface of the straight rod (31) and extends out the control slot (11) in the body (10). In the preferable embodiment, the neck (312) extends from the straight rod (31) at a position corresponding to the upper rack gear (311). The controller (313) is securely attached to the neck (312) outside the control slot (11) in the body (10).

The Z-shaped rod (33) has an inner end (not numbered), an outer end (not numbered), a hook (330) and a lower rack gear (331). The hook (33) is formed on the outer end, and the lower rack gear (331) is formed on the inner end of the Z-shaped rod (33). The pinion gear (32) is mounted rotatably on the inner surface of the cavity of the body (10) and engages the upper rack gear (311) and the lower rack gear (331). When the controller (313) is pushed or pulled, the straight rod (31) and the Z-shaped rod (33) are pushed to extend the hooks (310, 330) or pulled to retract the hooks (310, 330) back inside-the body (10) through the hook slots (101).

The optional label tab (40) has an inner surface (not numbered), two keyways (not numbered) and two detents (41) defined through the label tab (40).

Figure 4:
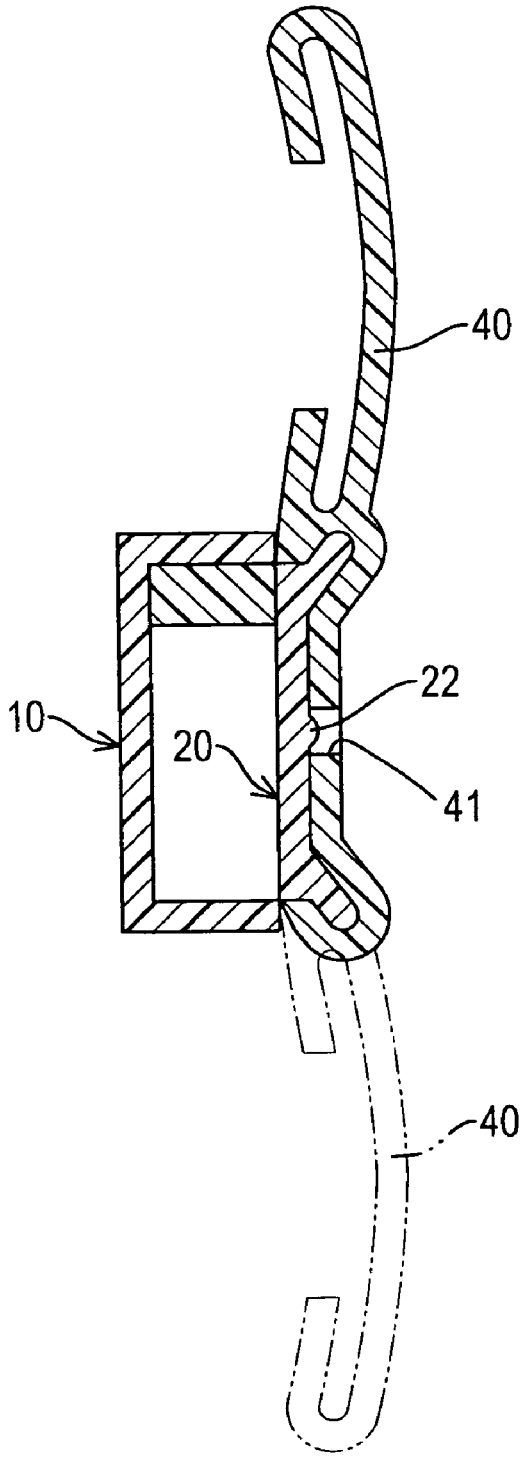
FIG. 4 is a side plan view of a label tab attached to the binder in FIG. 1.

With reference to FIG. 4, the label tab (40) is mounted on the suspension file by sliding the keyways of the label tab (40) onto the lips (21) on the cover (20).

Figure 5:
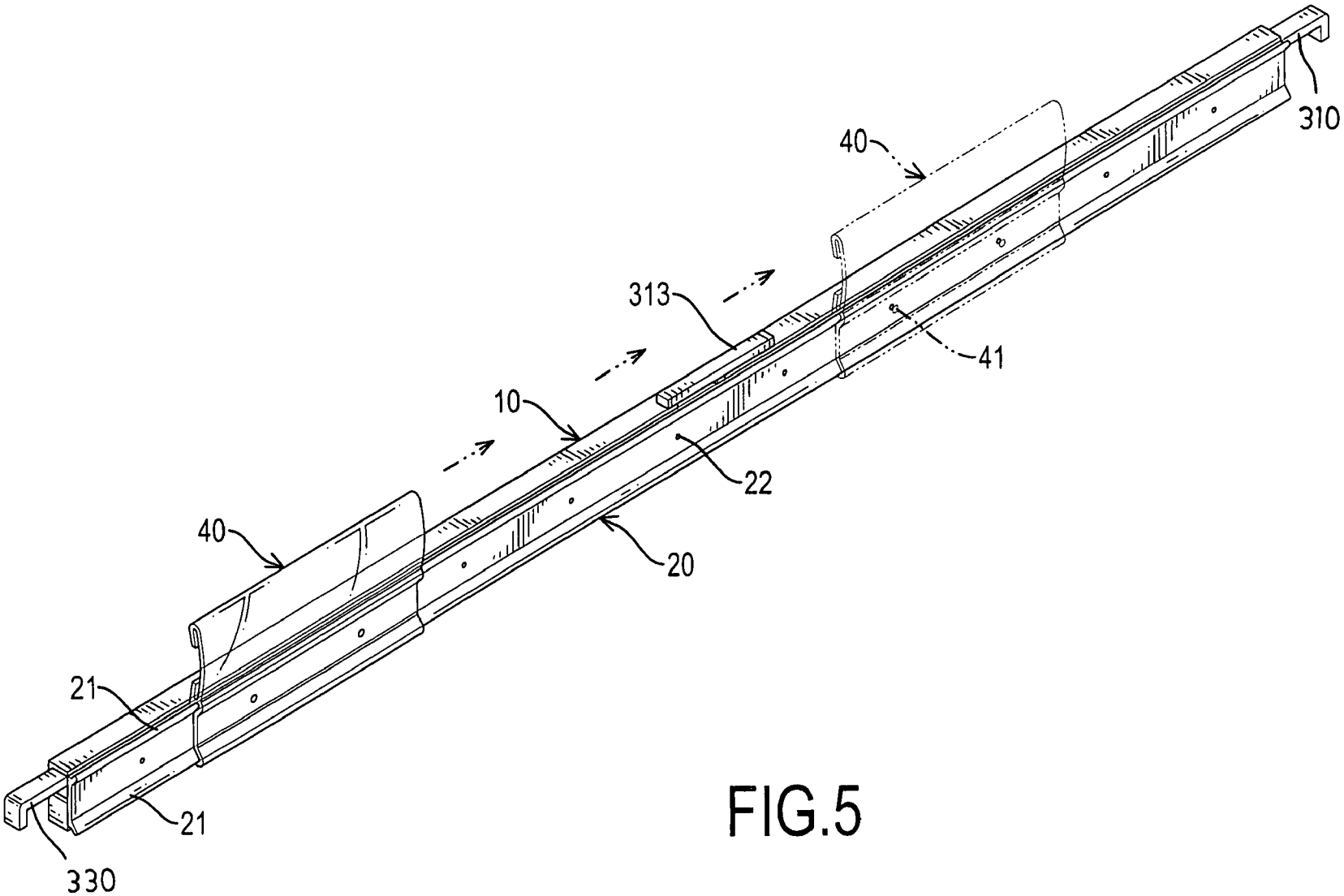
FIG. 5 is a perspective view of the binder for the suspension file in FIG. 1.

When the label tab (40) is used, the keyways are mounted on the lips (21) so the label tab (40) extends out from the suspension file so a label mounted in or attached to the label tab (40) is visible. With further reference to FIG. 5, the label tab (40) is positioned on the cover (20) of the binder by sliding the label tab (40) on the lips (21) until a nub (22) in a desired position on the cover (20) engages a detent (41) in the label tab (40).

When the label tab (40) is not used, the keyways are mounted on the lips (21) so the label tab (40) toward the folder of the suspension file.

Figure 6:
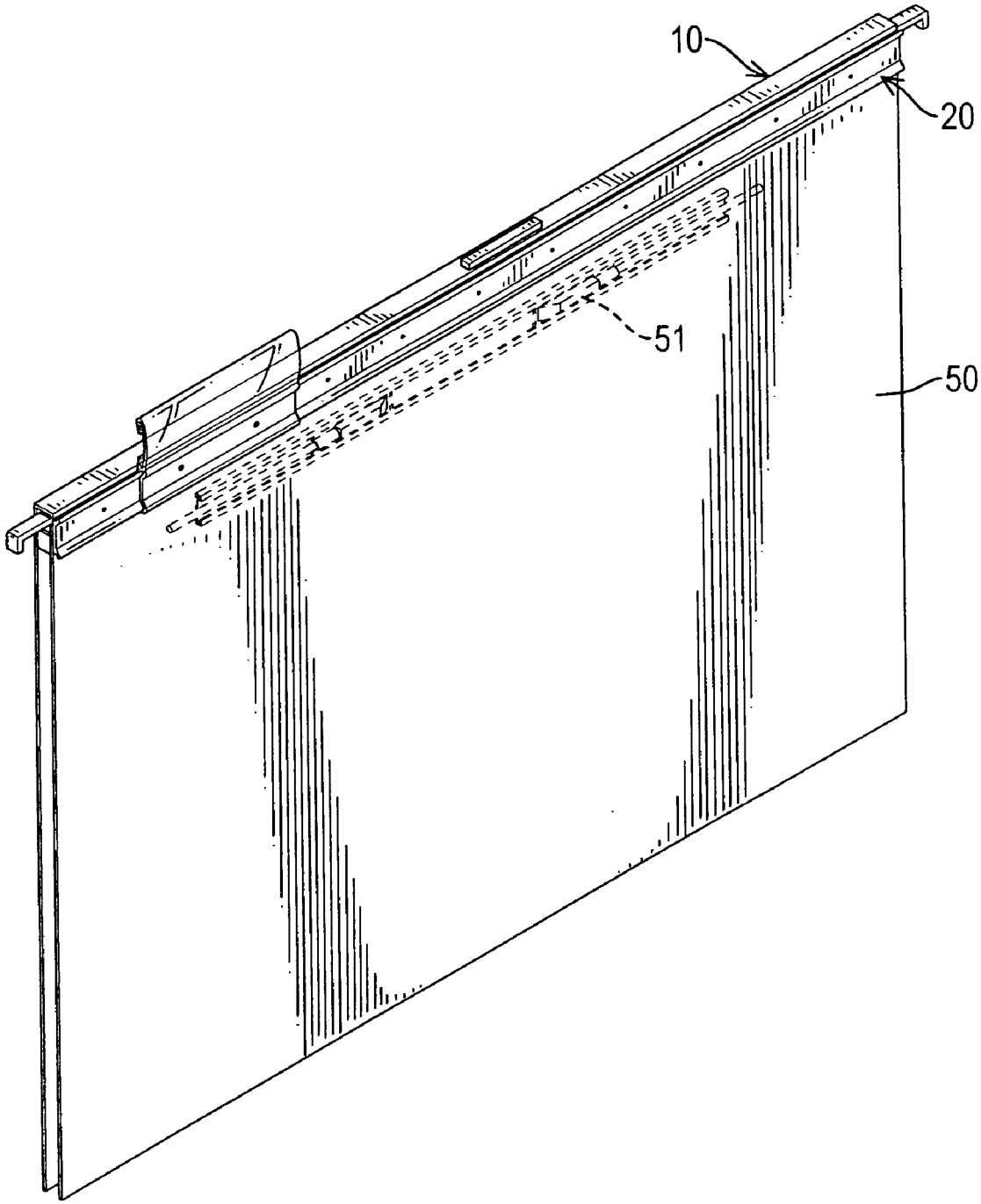
FIG. 6 is a perspective view of a first embodiment of the suspension file with the binder in accordance with the present invention.
Figure 7:
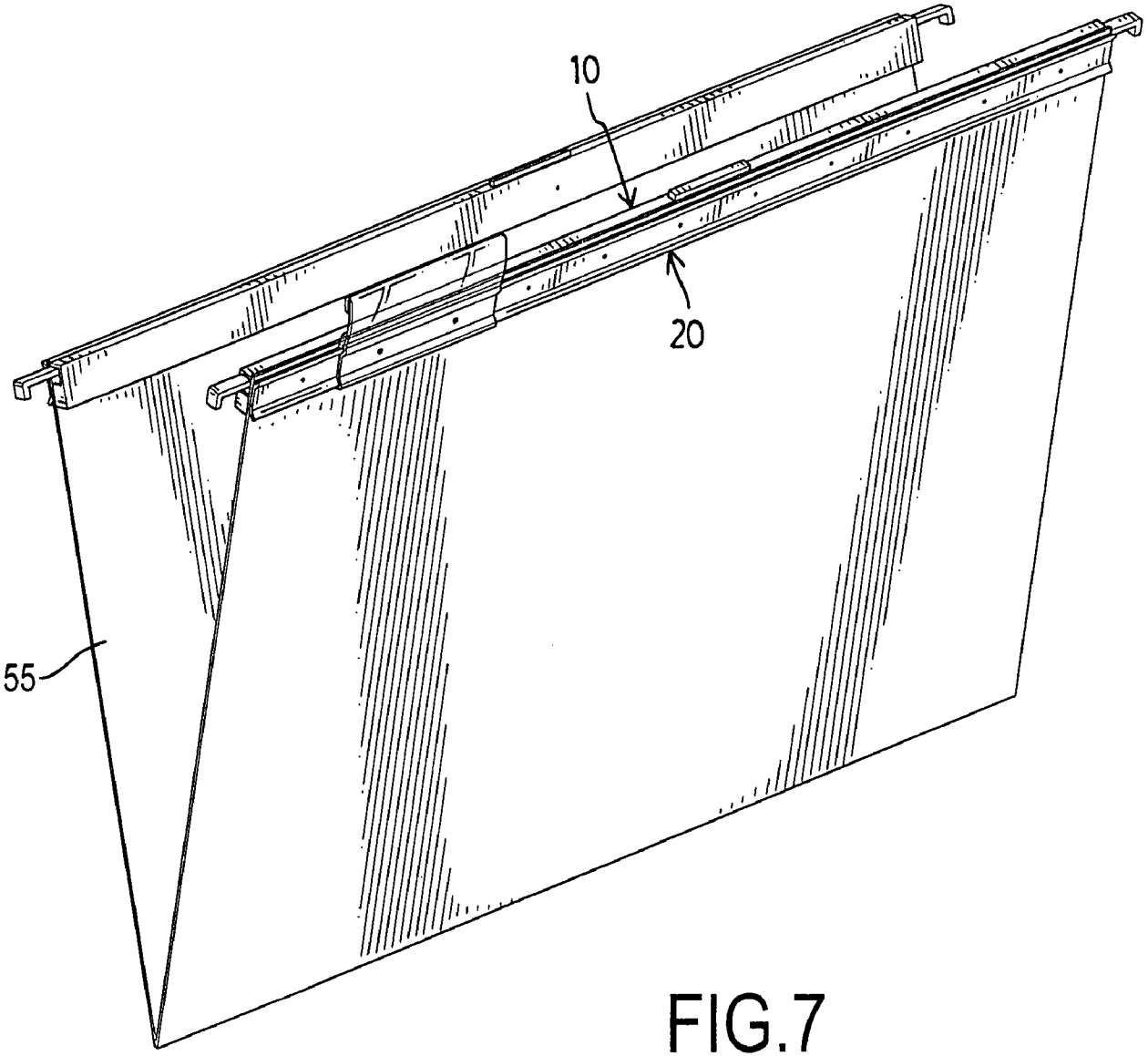
FIG. 7 is a perspective view of a second embodiment of a suspension file with a binder in accordance with the present invention.
Figure 8:
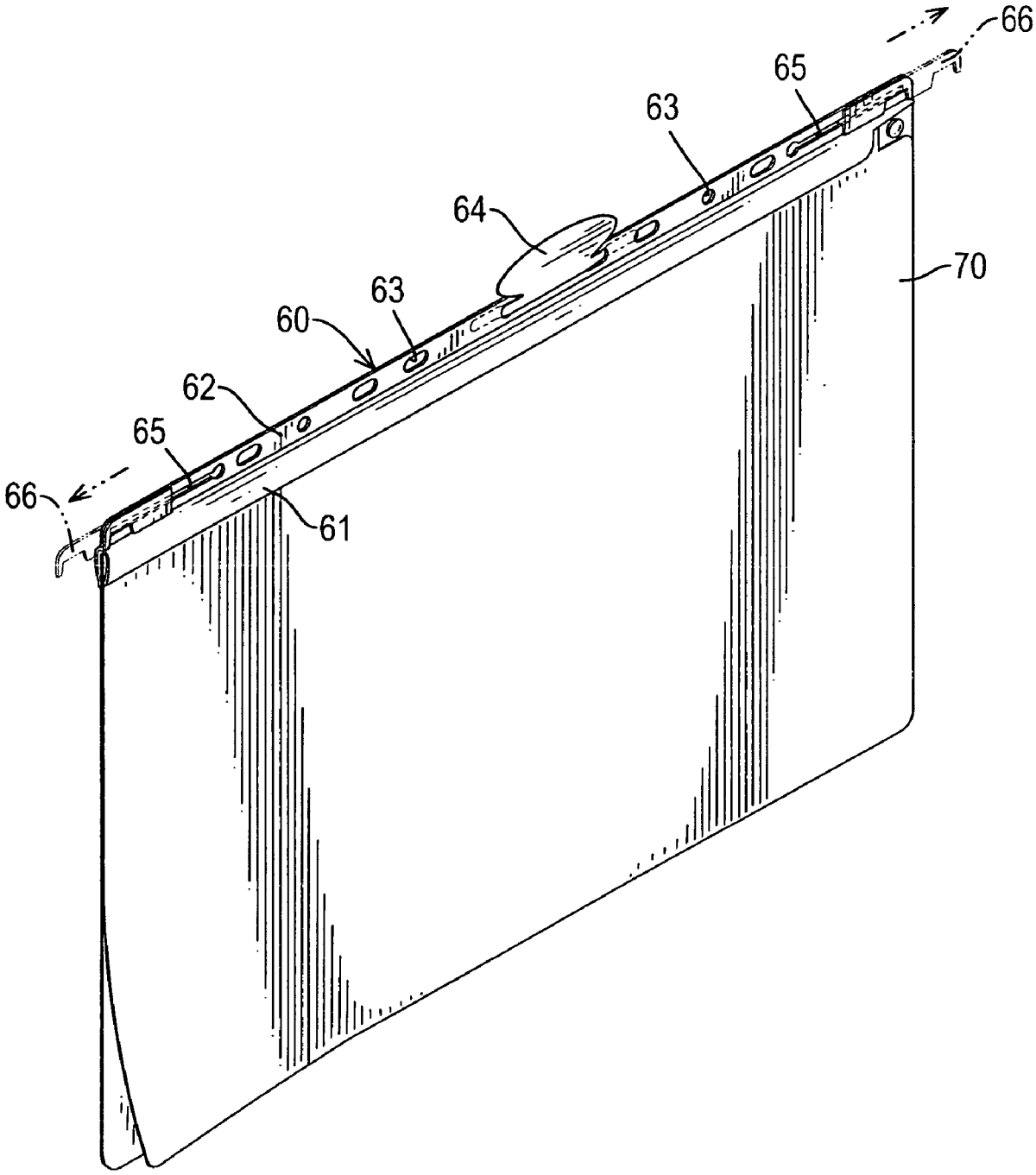
FIG.8 PRIOR ART
FIG. 8 is a perspective view of a first conventional suspension file in accordance with the prior art.
Figure 9:
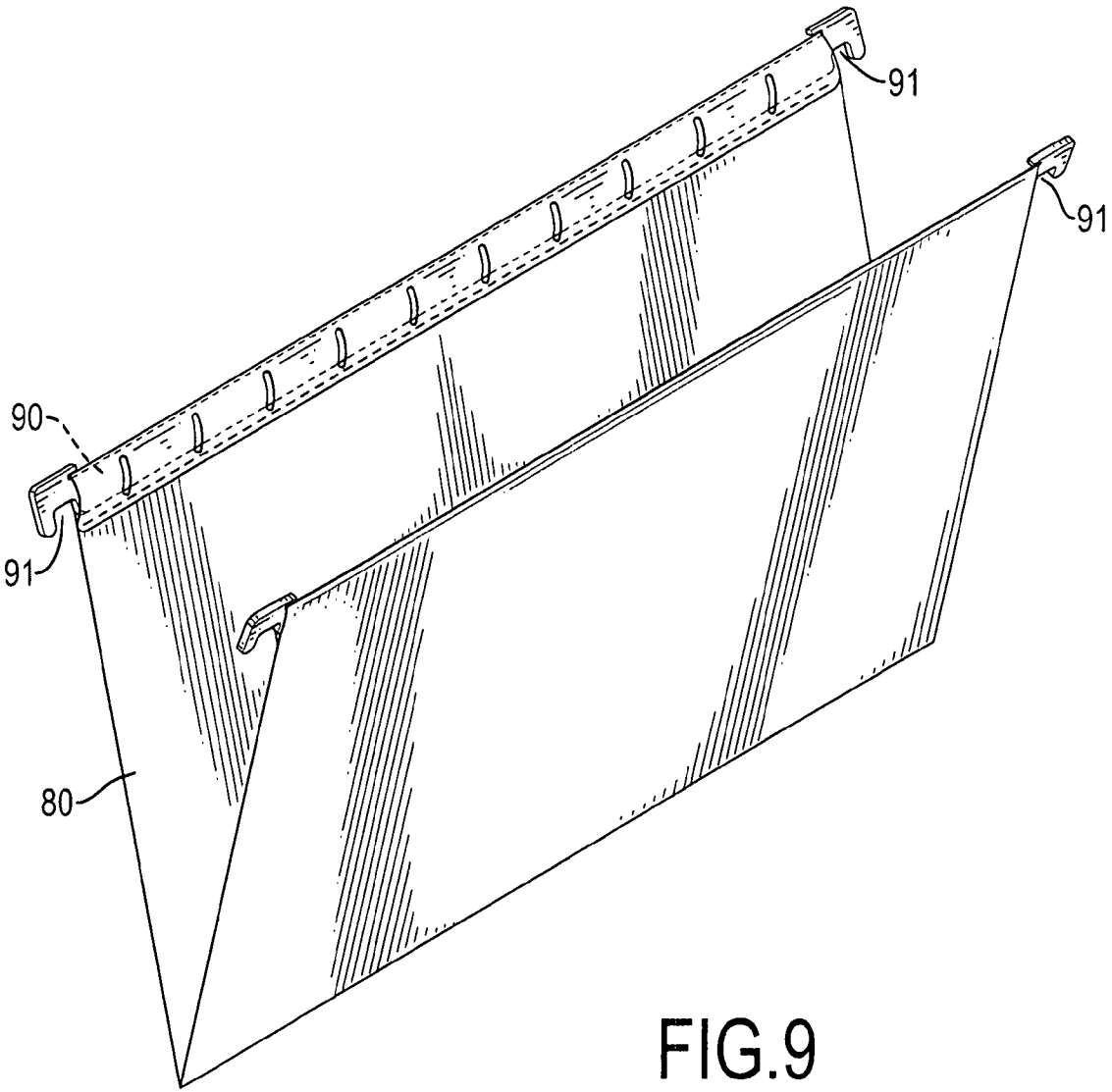
FIG.9 PRIOR ART
FIG. 9 is a perspective view of a second conventional suspension file in accordance with the prior art.

With reference to FIGS. 6 and 7, the binder can be used with different types of folders (50, 55) to form different types of suspension files.

The first embodiment of a suspension file in accordance with the present invention has a binder and a report type folder (50). The report type folder (50) has a front cover (not numbered), a rear cover (not numbered) and a fastener binder (51) mounted on one of the rear cover near the binder. The fastener binder (51) is used to hold documents.

The second embodiment of a suspension file in accordance with the present invention has two binders and a folded file folder (55). The folded file folder (55) has two top edges (not numbered), and the binders are mounted respectively on the top edges of the folded file folder (55).

The binder for the suspension file in accordance with the present invention has the following advantages.

1. The hooks (310, 330) on straight rod (31) and the Z-shaped rod (33) can be extended and retracted simultaneously, just by pushing or pulling the controller (313). The binder in the present invention provides a convenient way to use the suspension file.

2. Because the hooks (310, 330) can be retracted inside the binder, the suspension file with the binder in accordance with the present invention requires a minimum volume when packaged.

3. The label tab (40) can be positioned at various locations on the binder a label tab (40) on one binder will not hide the label tab (40) on the next binder in sequence.

The invention may be varied in many ways by a person skilled in the art. Such variations are not to be regarded as a departure from the spirit and scope of the invention, and all such modifications are intended to be included within the scope of the following claims.

What is claimed is:

1. A binder for a suspension file comprising a body having
- a top surface,
- a cavity,
- two end surfaces,
- two hook slots defined respectively on the end surfaces near the top surface of the body,
- an inner surface,
- a control slot defined in the top surface of the body,
- multiple guides formed on the inner surface of the cavity and aligned with each other to form a sliding path, and
- multiple female cover connectors formed on the inner surface of the inner cavity, a cover mounted on the body to close the cavity and having
- an inner surface,
- an outer surface,
- a top edge,
- a bottom edge, and
- multiple connector posts formed on the inner surface of the cover and face and correspond respectively to the female cover connectors, a control element mounted in the cavity in the body and having
- a straight rod slidably mounted inside the sliding path and having
  - a top surface,
  - a neck securely formed on the top surface of the straight rod and extending out the control slot in the body,
  - a controller securely attached to the neck outside the control slot of the body,
  - an inner end,
  - an outer end,
  - a hook formed on the outer end of the straight rod, and
  - an upper rack gear formed on the inner end of the straight rod,
- a Z-shaped rod slidably mounted inside the sliding path and having
  - an inner end,
  - an outer end,
  - a hook formed on the outer end, and
  - a lower rack gear formed on the inner end of the Z-shaped rod, and
- a pinion gear mounted rotatably on the inner surface of the cavity of the body and engages the upper rack gear and the lower rack gear.

2. The binder for a suspension file as claimed in claim 1, wherein the cover further comprises two lips formed respectively on the top edge and the bottom edge of the cover, and the binder further comprises a label tab having keyways attached to the lips of the cover.

3. The binder for a suspension file as claimed in claim 2, wherein the label tab further comprises multiple detents defined through the label tab, and the cover further comprises multiple nubs formed on the outer surface, wherein the nubs face the detents in the label tab when the label tab is attached to the cover.

* * * * *